US008512810B2

(12) United States Patent
Fernando et al.

(10) Patent No.: US 8,512,810 B2
(45) Date of Patent: Aug. 20, 2013

(54) SHEAR-INDUCED ALIGNMENT OF NANOPARTICLES IN COATINGS

(75) Inventors: Raymond H. Fernando, Arroyo Grande, CA (US); Lucas J. Brickweg, Richfield, MN (US); Bryce R. Floryancic, Union City, CA (US)

(73) Assignee: Cal Poly Corporation, San Luis Obispo, CA (US)

( * ) Notice: Subject to any disclaimer, the term of this patent is extended or adjusted under 35 U.S.C. 154(b) by 981 days.

(21) Appl. No.: 11/741,131

(22) Filed: Apr. 27, 2007

(65) Prior Publication Data

US 2010/0137494 A1 Jun. 3, 2010

Related U.S. Application Data

(60) Provisional application No. 60/796,227, filed on Apr. 28, 2006.

(51) Int. Cl.
*B05D 3/02* (2006.01)

(52) U.S. Cl.
USPC ..... 427/372.2

(58) Field of Classification Search
USPC ..... 427/372.2
See application file for complete search history.

(56) References Cited

U.S. PATENT DOCUMENTS

| | | | | |
|---|---|---|---|---|
| 6,020,419 | A * | 2/2000 | Bock et al. | 524/590 |
| 6,194,513 | B1 * | 2/2001 | Sagiv | 524/832 |
| 2001/0027797 | A1 * | 10/2001 | Yoshioka et al. | 134/1 |

OTHER PUBLICATIONS

Reetz et al. "Size-Selective Synthesis of Nanostructured Transition Metal Clusters" J. Am. Chem. Soc. v116, 1994, p. 7401-7402.*
Kim et al. "Micromolding in Capillaries: Applications in Material Science" J. Am. Chem. Soc. v118, 1996, p. 5722-5731.*
Ackerson, "Shear-Induced Melting," *Phys. Rev. Lett.* 46(2): 123-126 (1981).
Ackerson, "Shear induced order and shear processing of model hard sphere suspensions," *J. Rheol.* 34(4): 553-590 (1990).
Bhatt et al., "Control and Modeling of the Dielectrophoretic Assembly of On-Chip Nanoparticle Wires," *Langmuir* 20: 467-476 (2004).
Chung et al., "Fabrication and Alignment of Wires in Two Dimensions," *Journal of Physical Chemistry* 102 (35): 6685-6687 (1998).
Cohen et al., "Shear-Induced Configuration of Confined Colloidal Suspensions," *Phys. Rev. Lett.* 93(4): 046001-1-046001-4 (2004).
Haw et al., "Direct Observation of Oscillatory-shear-induced Order in Coloidal Suspensions," *Phys. Rev. E.* 57(6): 6859-6865 (1998).
Kretschmer et al., "Pearl Chain Formation of Nanoparticles in Microelectrode Gaps by Dielectrophoresis," *Langmuir* 20: 11797-11801 (2004).
Pham et al., "A Multidye Nanostructured Material for Optical Data Storage and Security Data Encryption," *Adv. Mater.* 16(6): 516-520 (2004).

(Continued)

*Primary Examiner* — Nathan Empie
(74) *Attorney, Agent, or Firm* — Knobbe Martens Olson & Bear LLP

(57) ABSTRACT

Methods and apparatuses for forming linear nanoparticle arrays, and the nanoparticle formulations formed therewith, are described. The nanoparticle arrays may be incorporated into coating materials, and in one example may be provided at or near the surface of two-component polyurethane coatings for use in automotive refinish clear coats. Coatings incorporating such nanoparticles may be applied to a substrate under shear to cause the nanoparticles to arrange linearly.

19 Claims, 13 Drawing Sheets

(56) References Cited

OTHER PUBLICATIONS

Shenhar et al., "Polymer-Mediated Nanoparticle Assembly: Structural Control and Applications," *Adv. Mater*. 17(6): 657-669 (2005).
Shi et al., "Formation of Cobalt Oxide Nanotubes: Effect of Intermolecular Hydrogen Bonding between Co(III) Complex Precursors Incorporated onto Colloidal Templates," *Nano Letters* 2(4): 289-293 (2002).
Tang et al., "One-Dimensional Assemblies of Nanoparticles: Preparation, Properties, and Promise," *Adv. Mater*. 17(8): 951-962 (2005).
Winkleman et al., "Directed Self-Assembly of Spherical Particles on Patterned Electrodes by an Applied Electric Field," *Adv. Mater*. 17: 1507-1511 (2005).
Zhong et al., "Fractured polymer/silica fiber surface studied by tapping mode atomic force microscopy," *Surf. Sci. Lett*. 290: L688-L692 (1993).

* cited by examiner

SHEAR-INDUCED ALIGNMENT OF NANOPARTICLES IN COATINGS

CROSS-REFERENCE TO RELATED APPLICATION

This application claims the benefit of U.S. Provisional Application No. 60/796,227, filed Apr. 28, 2006, the entirety of which is hereby incorporated by reference.

BACKGROUND OF THE INVENTION

1. Field of the Invention

Embodiments of the present invention relate to methods for distributing nanoparticles on substrate surfaces, more specifically to methods for forming and/or distributing nanoparticles in an ordered fashion on substrate surfaces.

2. Description of the Related Art

Experimental and theoretical aspects of highly ordered colloidal particle assemblies have received a great deal of attention in recent years. See, e.g., *J. Rheol.* 1990, 34(4) 553-590 by Ackerson, B.; *Phys. Rev. Lett.* 1981, 46(2), 123 by Ackerson, B; *Phys. Rev. Lett.* 2004 93(4), 04600-1 by Cohan, I., Mason, T. G., and Weitz, D. A.; *Phys. Rev. E.* 1998, 57(6) 6859-6864 by Haw, M. D. Poon, W. C. K., and Pusey, P. N.; *Adv. Mater.* 2004, 16(9), 516 by Pham, H. H., Gourevich, I., Oh, J. K., Jonkman, J. E. A., and Kumacheva, E.; G. M., *Adv. Mater.* 2005, 17, 1507-1511 by Winkleman, A., Gates, B., McCarty, L. S., and Whitesides; and *Adv. Mater.* 2005, 17(6), 657 by Shenhar, R., Norsten, T. B., and Rotello, V. M., all of which are incorporated herein by reference in their entirety.

In particular, arrangement of nanomaterials (or nanoparticles) in one dimension has been the focus of a considerable number of studies. Applications in, e.g., electronics, optics and medical science, etc., could benefit from the unique properties of these materials. See, e.g., *Nano Letters.* 2 (4) 289-293. (2002) by Xiangyang Shi, Shubo Han, Raymond J. Sanedrin, Cesar Galvez, David G. Ho, Billy Hernandez, Feimeng Zhou, and Matthias Selke, the entirety of which is incorporated herein by reference. If nanomaterials can be arranged into useful structures, a number of possible uses for nanoelectronic devices may arise. See, e.g., *Journal of Physical Chemistry* 102 (35) 6685-6687 (1998) by S.-W. Chung, G. Markovich, and J. R. Heath, the entirety of which is incorporated herein by reference.

A typical goal of arranging nanomaterials is the production of nano-scale conductive wires for electronics applications. While production of nanowires is commonly known in the art, production of substantially linear and ordered nanowires spanning several micrometers in length has posed a challenge.

Methods utilized in arranging nanoparticles into nanowires include vapor phase deposition, monolayer deposition, and dielectrophoresis. See, e.g., *Langmuir* 20, 11797-11801 (2004) by Robert Kretschmer and Wolfgang Fritzsche, and. *Langmuir* 20, 467-476 (2004) by Ketan H. Bhatt, Orlin D. Velev, all of which are incorporated herein by reference. Structures are typically difficult to achieve using these methods, and when formed are typically not single, straight lines but rather branched arrays of curved lines.

Literature on 1-D particle arrangements is limited, but an extensive review has been recently published. See, e.g., *Adv. Meter.,* 2005, 17(8), 951 by Tang, Z. and Kotov, N. A., the entirety of which is incorporated herein by reference. The two most common types of nanowires are fibers and pearl-chain structures. Pearl-chain structures comprise a plurality of nanoparticles arranged in a pearl-like fashion. The most widely reported method for producing pearl-chain formations is dielectrophoresis, and other electrochemical or electrostatic processes. See, e.g., *Langmuir,* 2004, 20 11797-11801 by Kretschmer, R., Fritzsche, W.; G. M., *Adv. Mater.* 2005, 17, 1507-1511 by Winkleman, A., Gates, B., McCarty, L. S., and Whitesides; and *Langmuir,* 2004, 20, 467 by Bhatt, K. H., and Velev, O. D., all of which are incorporated herein by reference.

Pearl-chain structures produced by methods commonly available in the art tend to be curved and can be at least a few nanoparticles wide. The earlier work has primarily focused on 2-D and 3-D ordered arrangements of nanoparticles. Nanoparticle arrays reported in the literature typically contain tens of lines, precluding their use in applications such as, e.g., state of the art electronics devices, for which substantially straight and thin conductive nanowires are desired.

SUMMARY OF THE INVENTION

Embodiments of the present invention are directed to methods and apparatuses for forming linear nanoparticle arrays, and the nanoparticle formulations formed therewith. The nanoparticle arrays may be incorporated into coating materials, and in one embodiment may be provided at or near the surface of two-component polyurethane coatings for use in automotive refinish clear coats. Coatings incorporating such nanoparticles may be applied to a substrate under shear to cause the nanoparticles to arrange linearly. In one embodiment, alumina nanoparticles at or below levels of about 1 wt. % of the cured film may be used. In one embodiment, nanoparticle strings of between about 200 microns and 5 cm in length may be produced, more preferably greater than about 300 microns.

According to an embodiment, a method of forming a linear particle string comprises providing a dispersion medium containing a plurality of nanoparticles; incorporating the dispersion into a coating material to form a coating mixture; applying the coating mixture to a substrate with a shear force; and curing the substrate and the coating mixture by a heat treatment, wherein the shear force causes the nanoparticles to arrange into a linear particle string on the substrate.

According to another embodiment, a method of forming a layer of 1-D nanowires comprises forming a mixture containing a plurality of nanoparticles; and applying a layer of the mixture to a surface with a shear force, wherein the shear force causes the nanoparticles to arrange into a plurality of linear 1-D nanowires on the surface.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

FIG. 10(*b*) shows an AFM micrograph of a coating containing Alumina C in ethyl acetate formed by the drawdown method according to an embodiment.

FIG. 10(*c*) shows an AFM micrograph of a coating containing Alumina C in ethyl acetate formed by the drawdown method according to an embodiment.

FIG. 10(*d*) shows an AFM micrograph of a coating containing Alumina C in ethyl acetate formed by the drawdown method according to an embodiment.

DETAILED DESCRIPTION OF THE PREFERRED EMBODIMENTS

In one embodiment, there is a need in the art for forming substantially straight pearl-chain structures comprising nanoparticles. The inventors have observed that by controlling coating parameters, parallel arrays of substantially linear nanowires with end-to-end distances spanning several centimeters can be formed. In preferred embodiments, methods are provided by which nanoparticles self-align into substantially straight, parallel lines (i.e., linearly-oriented nanostructures comprising a plurality of nanoparticles) under the application of shear forces. The lines produced by methods of preferred embodiments comprise nanoparticles preferably formed of oxides of metals and/or semiconductors, more preferably formed of material selected from the group consisting of aluminum oxide, silicon oxide, titanium dioxide, indium-tin oxide, zinc oxide and zirconium dioxide. In one embodiment, single, unbranched aluminum oxide nanoparticles arrange in an extended pearl-like fashion and hold their linearity for up to about 5 centimeters (cm). Preferred embodiments encompass alumina nanoparticles incorporated into automotive refinish polyurethane clear coats to improve scratch resistance, film clarity and adhesion of coatings to metal substrates.

DEFINITIONS

A "nanoparticle" is typically defined as a particle with at least one of its dimension less than about 100 nm. Nanoparticles may comprise clusters of one or more types of atoms, and can assume semiconducting, insulating and conducting properties. Nanoparticles can be arranged into functional structures, such as, e.g., nanospheres, nanorods, nanowires (or nanolines) and nanocups.

"Substrate" refers to any surface onto which nanoparticles can be distributed to form, e.g., nanowires. The substrate may be any semiconducting, metallic or insulating material. In some embodiments, the substrate is a semiconducting material, such as a form of silicon oxide (e.g., glass). In other embodiments, the substrate is a metallic surface defining the body of an automobile. In some embodiments, the substrate may include one or more layers atop a metallic, semiconducting, or insulating material.

"Sample" denotes a substrate on top of which nanoparticles have been distributed. In some cases, a sample may be a glass slide comprising individual nanoparticles or a pattern of parallel and substantially straight nanowires. In other cases, a sample may be a metallic surface comprising a pattern of nanowires.

Atomic Force Microscopy

Figure 1:
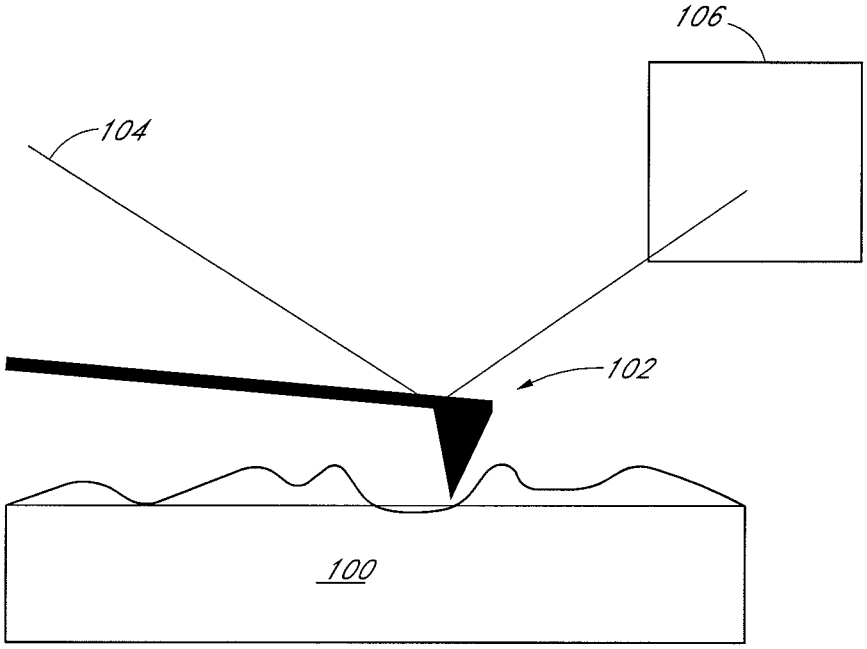
FIG. 1 shows a simplified schematic diagram of an Atomic Force Microscope.

Atomic Force Microscopy ("AFM") is a surface analytical tool for imaging nanometer-scale ("nanoscale") three-dimensional features on the surface of a substrate. In AFM, a tip mounted on a cantilever 102 is rastered across a substrate surface 100 while a laser 104 is directed to and reflected from the cantilever 102 and into a photodiode detector 106, as shown in FIG. 1. Features on the surface of the substrate 100 cause the tip of cantilever 102 to move vertically up and down, deflecting the laser 104. The deflection of the laser 104 is measured by the detector 106, which gives a topographical profile of the surface being scanned. Line profiles are compiled to form a three-dimensional representation of the substrate surface 100.

AFM can be used in "contact mode", where the force between the tip (e.g., ultrasharp silicon cantilever "C" tip) and the surface of the sample is kept constant, or in "close contact mode", where the tip oscillates on and off the surface at a predetermined frequency. In close contact mode, the tip comes in contact with the surface once each cycle and is subsequently removed 5. See, e.g., *Surf. Sci. Lett.* 290, L688 (1993) by Q. Zhong, D. Innis, K. Kjoller, V. B. Elings, the entirety of which is incorporated herein by reference. AFM advantageously requires minimal substrate preparation compared to other imaging techniques, such as, e.g., Scanning Electron Microscopy (SEM) and transmission electron microscopy (TEM), and can be performed in ambient conditions on solid or liquid surfaces. See, e.g., Pacific Nanotechnology, Inc. at http://www.pacificnano.com/nanoparticles_single.html, the entirety of which is incorporated herein by reference.

An AFM, such as, a Pacific Nanotechnology AFM utilizing a 1000× microscope with a video camera to aid in the placement of the scanning tip, may be used to assess the distribution of nanoparticles and nanostructures (e.g., nanolines). Grey "streaks" can be seen on the microscope screen, and when these streaks are scanned, nanoparticle lines can be found. Lines or strings can also be seen on the microscope screen as long chains of particles that substantially cover the surface of the sample.

Sample Preparation

According to an embodiment, commercially-available alumina nanoparticle dispersions are incorporated into a coating material (e.g., two-component polyurethane clear coats) at or below levels of about 1 wt. % of the cured film. Samples of the coating mixture comprising the incorporated nanoparticle dispersions and the coating material are prepared on pre-cleaned substrates (e.g., glass slides) using application methods with different levels and types of shear. According to one embodiment, after incorporation of the nanoparticle dispersions into the coating material and application of the coating mixture onto a substrate, the substrate is cured at a temperature of about 70° C. for about 30 minutes, although other temperatures between about 25° C. and 200° C. are also possible. It will be understood that the lower curing temperature necessitates a longer curing time. At 25° C., the preferred annealing time is about 7 days; at 200° C., the preferred curing time is about 10 minutes.

Examples of nanoparticle dispersions are shown in Table 1. Nanobyk 3610 and Nanobyk LPX are supplied by BYK-CHEMIE.

TABLE 1

| Nanoparticle dispersion used | | | | |
|---|---|---|---|---|
| Dispersion | Size Distribution | Dispersion Medium | % Solids | Silicone Surface Treatment? |
| Alumina A - Nanodure | 25 nm (85%) | Dipropylene glycol, n-butyl ether | 30 | No |
| Alumina B - Nanobyk 3601 | 25 nm (85%) | Triprolylene glycol diacrilate | 30 | Yes |
| Alumina C - Nanobyk 3610 | 25 nm (85%) | Methoxypropyl acetate | 32 | Yes |
| Alumina D - Nanobyk LPX | 25 nm (85%) | Methoxypropyl acetate | 32 | Yes |
| Silica A - Nanobyk 3650 | 25 nm (85%) | Methoxypropyl acetate/methoxy propanol | 32 | Yes |

Note that the nanoparticles along with their respective dispersion mediums referred to as "Alumina C" and "Alumina D" herein are the same nanoparticles along with their respective dispersion mediums referred to as "Alumina A" and "Alumina B" in U.S. Provisional Application No. 60/796,227, filed Apr. 28, 2006, which this application claims priority to. Accordingly, all the figures and corresponding description in the Provisional Application referring to "Alumina A" and "Alumina B" are repeated herein with reference to "Alumina C" and "Alumina D."

Effects of Application Methods

AFM analysis and the visual appearance of coatings according to embodiments of the invention indicated that, in general, the nanoparticles are well dispersed. Few areas of nanoparticle aggregates were found on the coatings according to embodiments. The different application methods according to embodiments of the invention and their corresponding shear forces will be further discussed below.

i. Application by Drop Deposition Method

According to one embodiment, about one drop of a coating material was placed on a glass slide and allowed to substantially level for about 10 minutes. The coating was subsequently cured at a temperature of about 70° C. for about 30 minutes. No linear nanoparticle formations were observed on the glass slide using the AFM. In one case, Alumina C (see Table 1) was applied to a first glass slide using a drop application method, which entailed placing a drop of the dispersion on the first glass slide. According to this case, linear formations of nanoparticles were not observed as shown in the AFM results of FIG. 2.

According to other embodiments, four drops of the coating for all of the above nanoparticles were placed on a glass slide, allowed to flow-out and spread for 10 minutes, and cured under the same conditions as above (70° C. for 30 min). No linear formations were found by the AFM analysis. Very few aggregates were visible with the optical microscope attached to the AFM, and they did not yield any evidence of linear particle strings.

ii. Application by Drawdown Method

Figure 3:
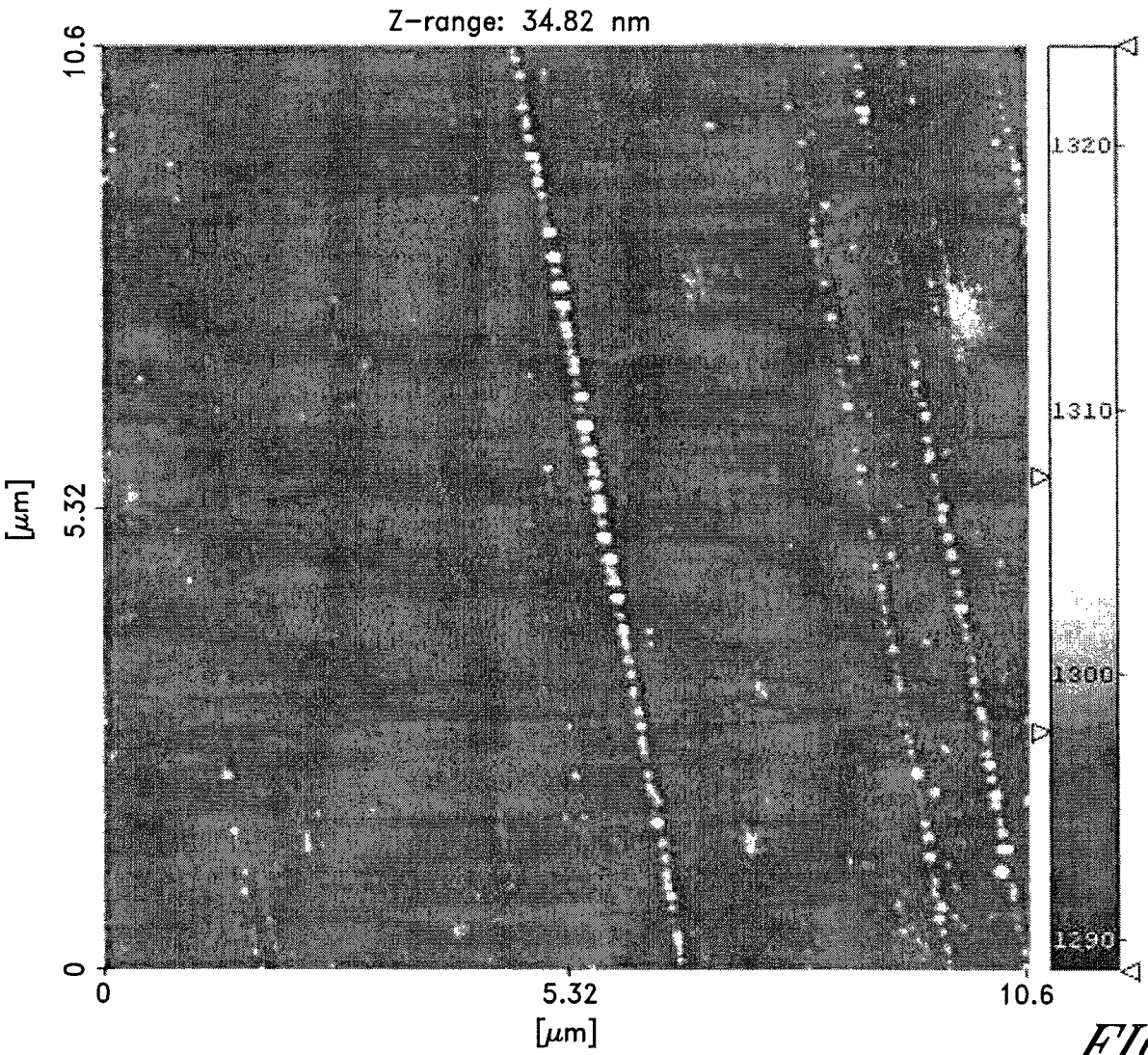
FIG. 3 shows an AFM micrograph of a coating containing Alumina C nanoparticles formed by the drawdown method according to an embodiment.
Figure 4:
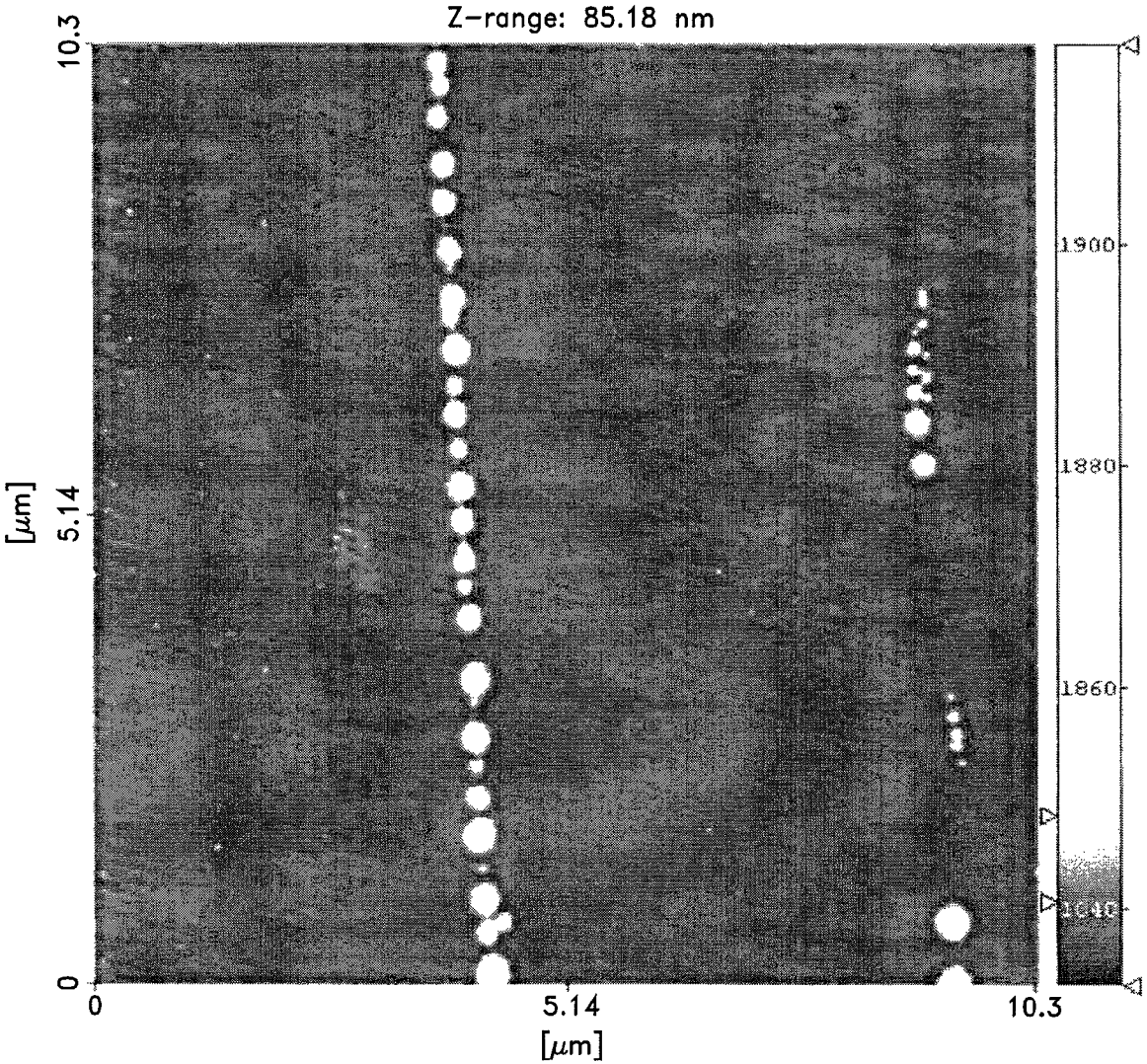
FIG. 4 shows an AFM micrograph of a coating containing Alumina D nanoparticles formed by the drawdown method according to an embodiment.

According to another embodiment, Alumina C was applied to a second glass slide using a drawdown applicator (25 mm Cube Film Applicator from Sheen Instrument Company) at a rate of about 5 cm/sec. Referring to FIG. 3, linear formations with lengths of at least a few hundred microns were observed with AFM. The same method and conditions were applied to Alumina D and the AFM results are shown in FIG. 4.

The drawdown application method produced nanoparticle strings that are very straight and continuous for a few hundred microns for other coating mixtures as well. AFM height images of coatings containing Alumina C (0.67 wt. %) and Alumina D (1.0 wt. %) are shown in FIG. 3 and FIG. 4, respectively. These samples were prepared at an application speed of about 5 cm/sec. Stable, multiple, straight-line formations of alumina nanoparticles were observed on both coatings. In some areas, well-defined single strings of nanoparticles were found. As the application speed increased from 1 to 10 cm/sec, the number and the length of particle strings increased. Similar results were obtained for samples containing Silica A nanoparticles (not shown).

iii. Application by Spray Method

Figure 5:
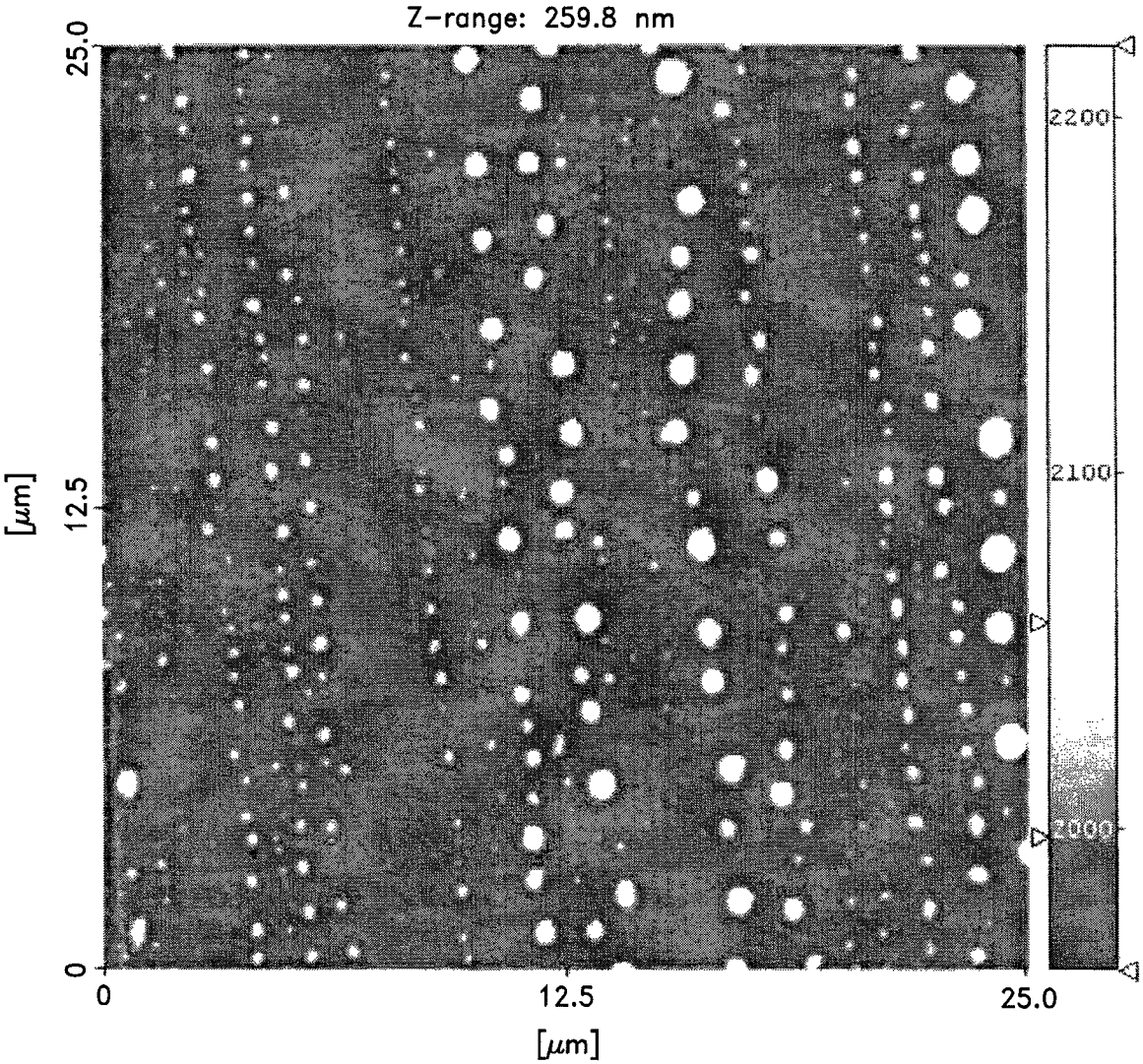
FIG. 5 shows an AFM micrograph of a coating containing Alumina C nanoparticles formed by the spray method according to an embodiment.
Figure 6:
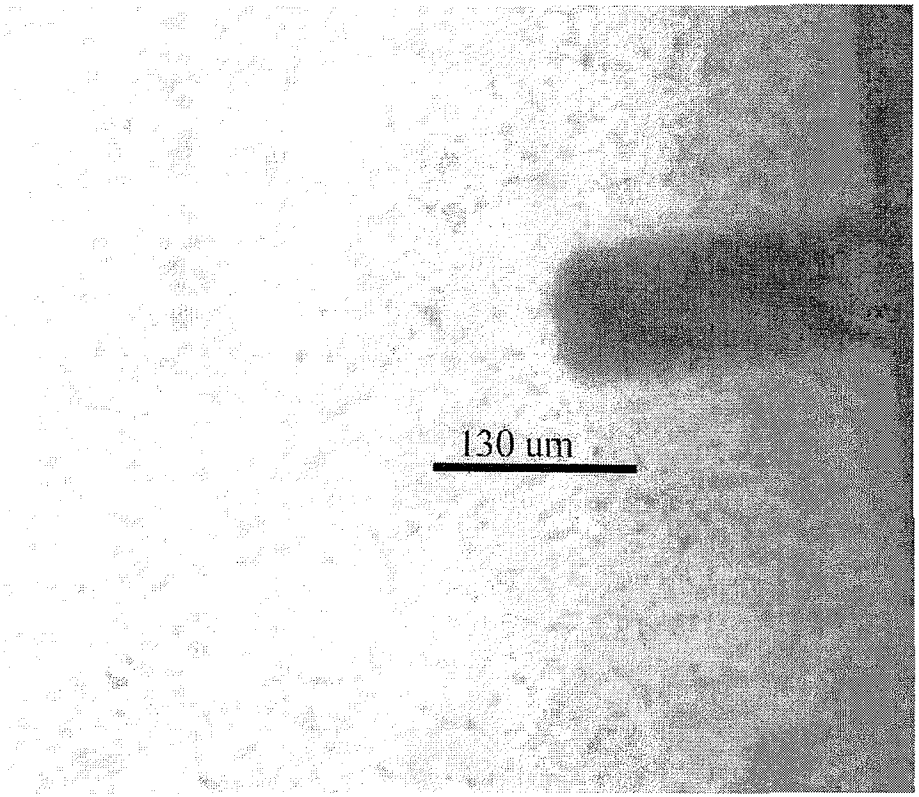
FIG. 6 shows an optical micrograph of a coating containing Alumina C nanoparticles formed by the spray method according to an embodiment.

According to another embodiment, Alumina C was applied to a glass slide using a spray application method. The spray application method produced the largest number of particle strings covering the entire microscopic slide. Referring to the AFM results of FIG. 5, the alumina nanoparticles covered substantially the entire microscope slide. As shown, the particle strings are indicated by grey "streaks" that can be seen on the microscrope screen. Strings are also visible on the optical microscope and SEM, and have been measured to be more than 5 cm long with a 0.5 wt. % Alumina C sample prepared by spray method. Referring to the optical micrograph (1000×) of FIG. 6, parallel lines were observed over the entire slide for the above sample containing Alumina C, matching the direction of application. Samples prepared using the spray application method contained many parallel lines of different particle sizes, and showed the longest one-dimensional arrangements as compared to samples prepared using the drawdown method.

Figure 7:
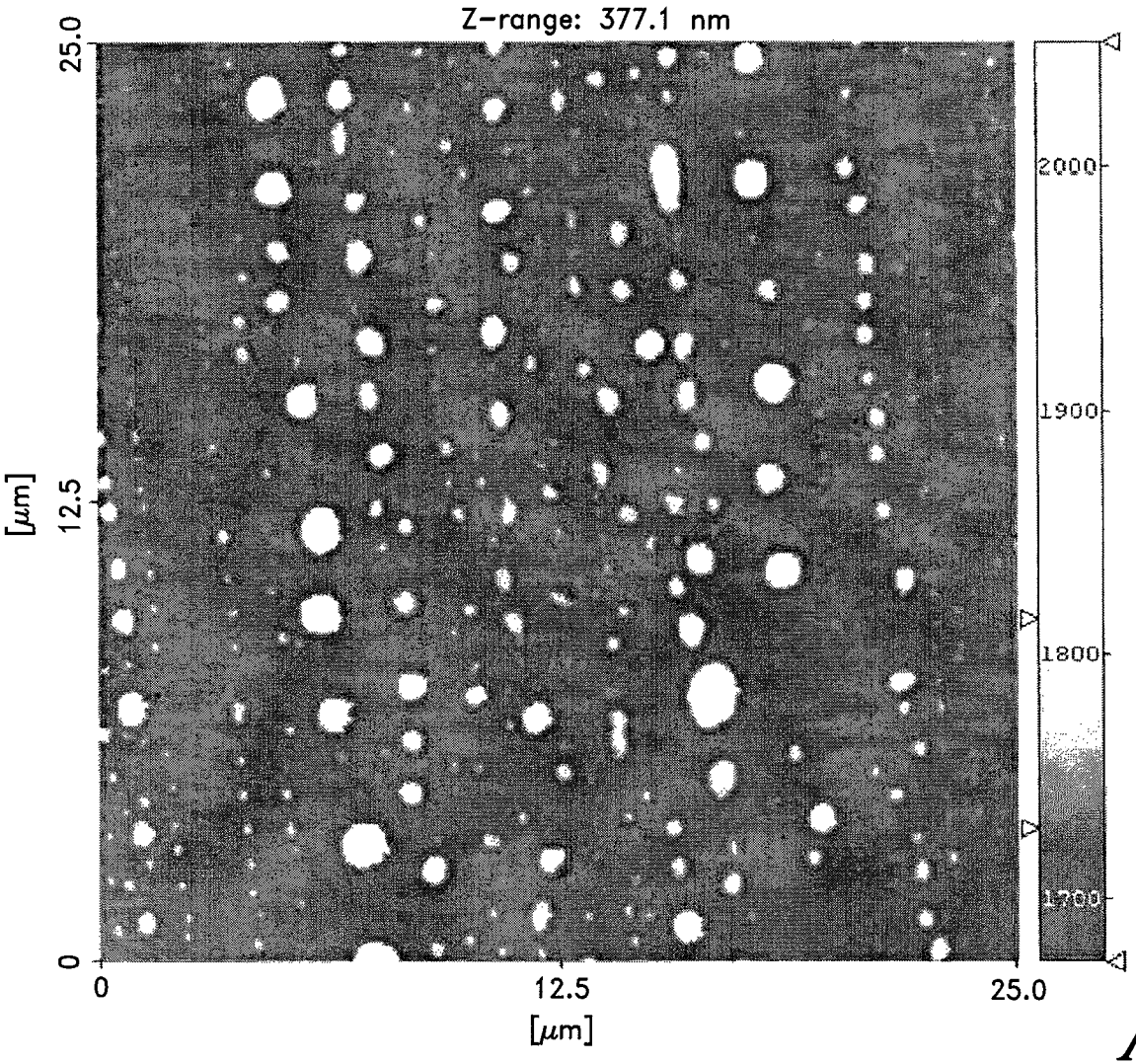
FIG. 7 shows an AFM micrograph of a coating containing Alumina C nanoparticles formed by the spray method according to an embodiment.
Figure 8:
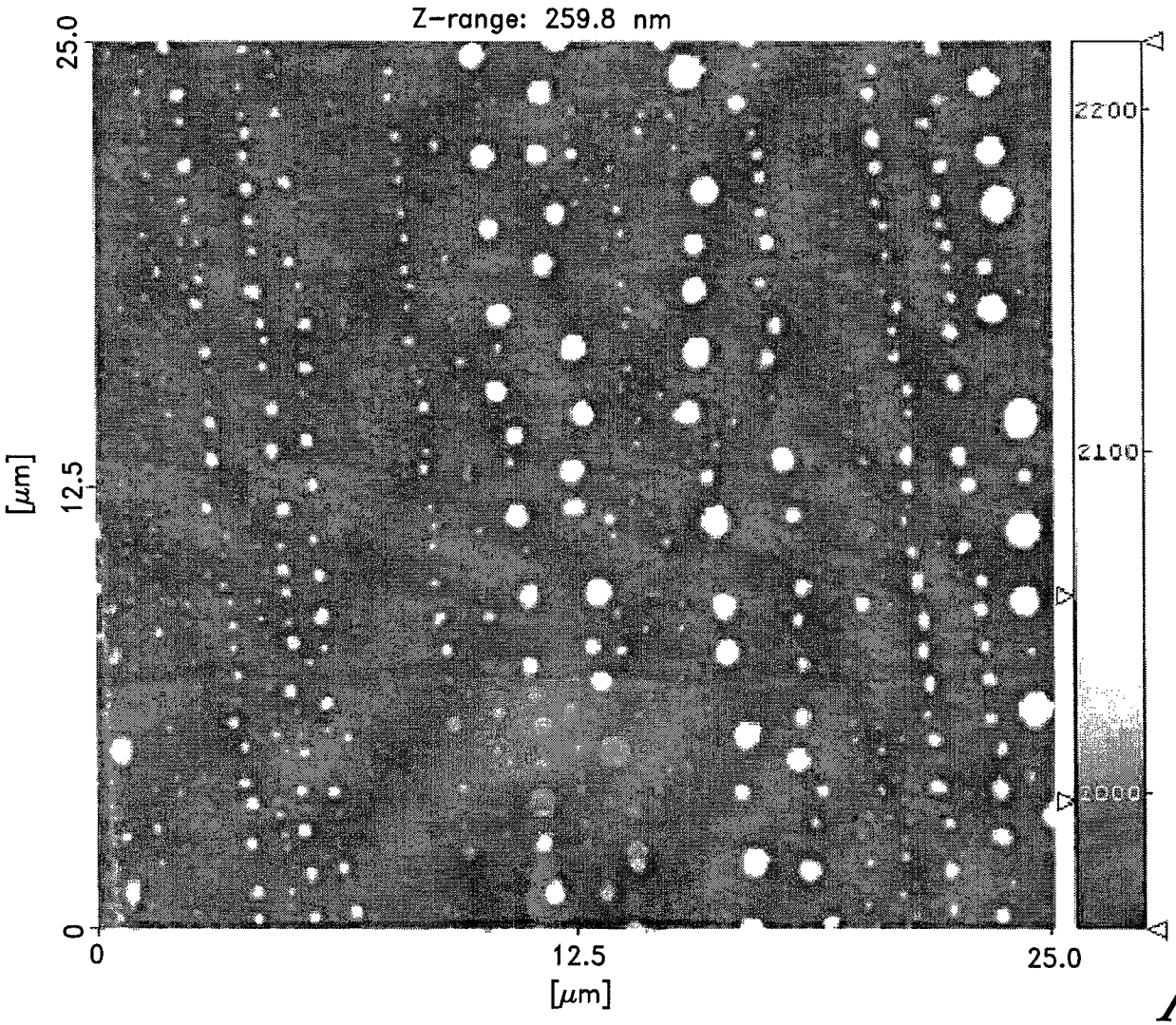
FIG. 8 shows an AFM micrograph of a coating containing Alumina C nanoparticles formed by the spray method according to an embodiment.
Figure 9:
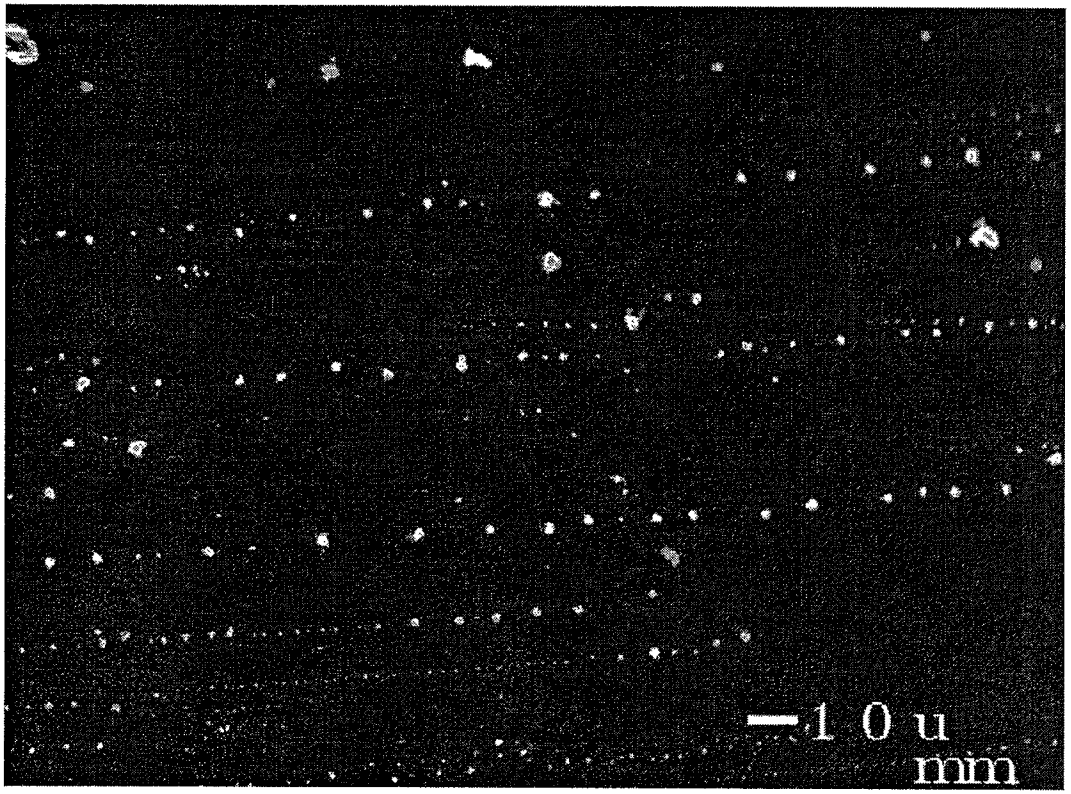
FIG. 9 shows an SEM micrograph of a coating containing Silica A nanoparticles formed by the spray method according to an embodiment.
Figure 10A:
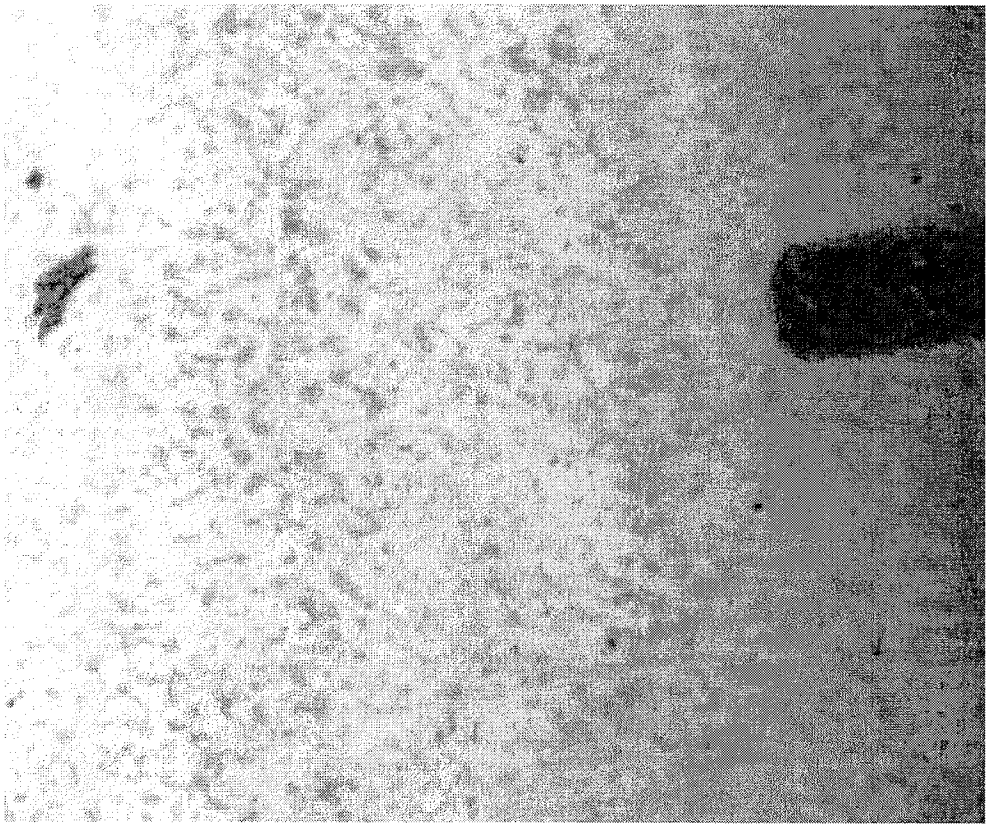
FIG. 10(*a*) shows an optical micrograph of a coating containing Alumina C in ethyl acetate formed by the drawdown method according to an embodiment.
Figure 10B:
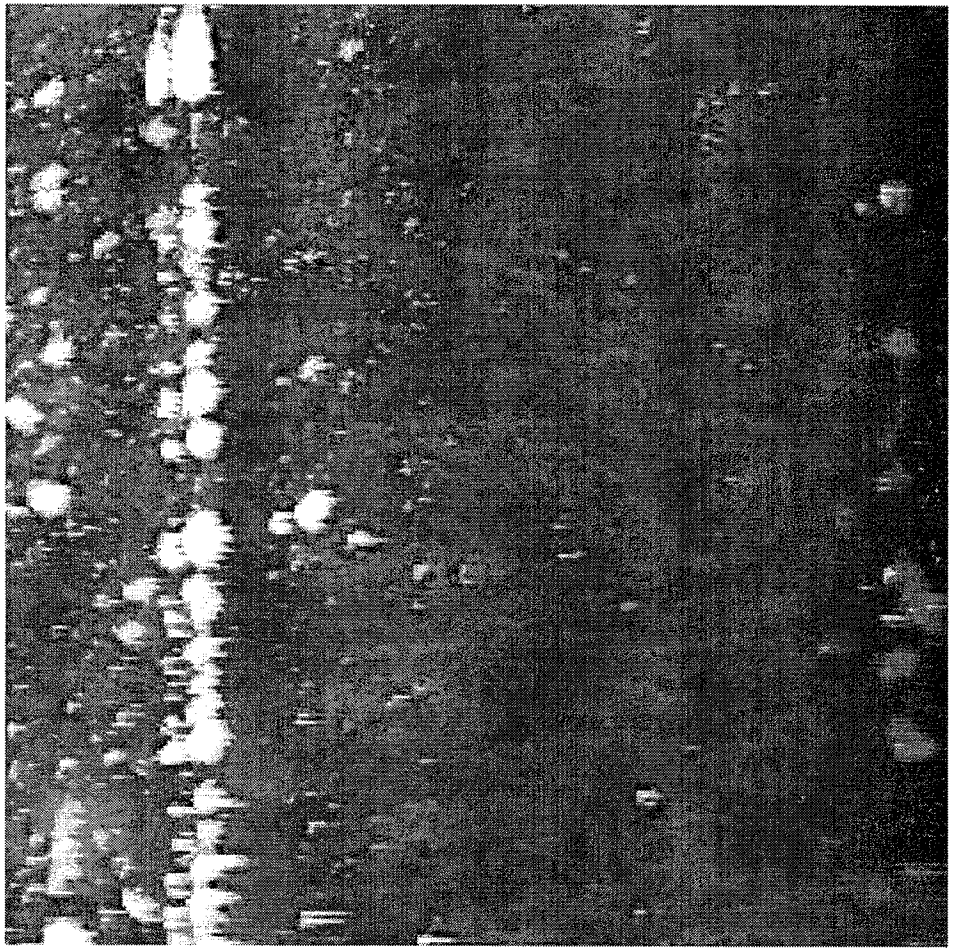
Figure 10C:
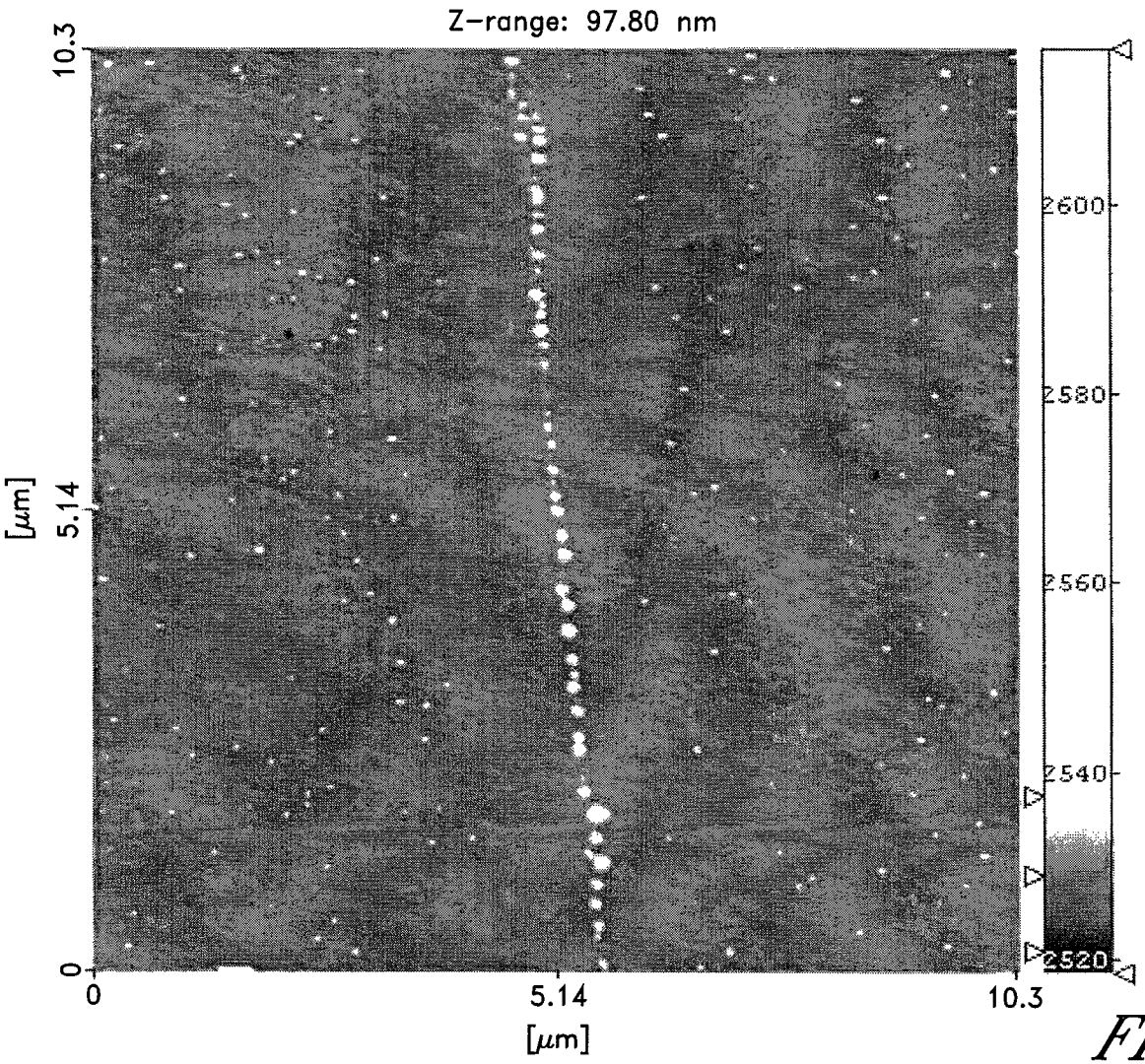
Figure 10D:
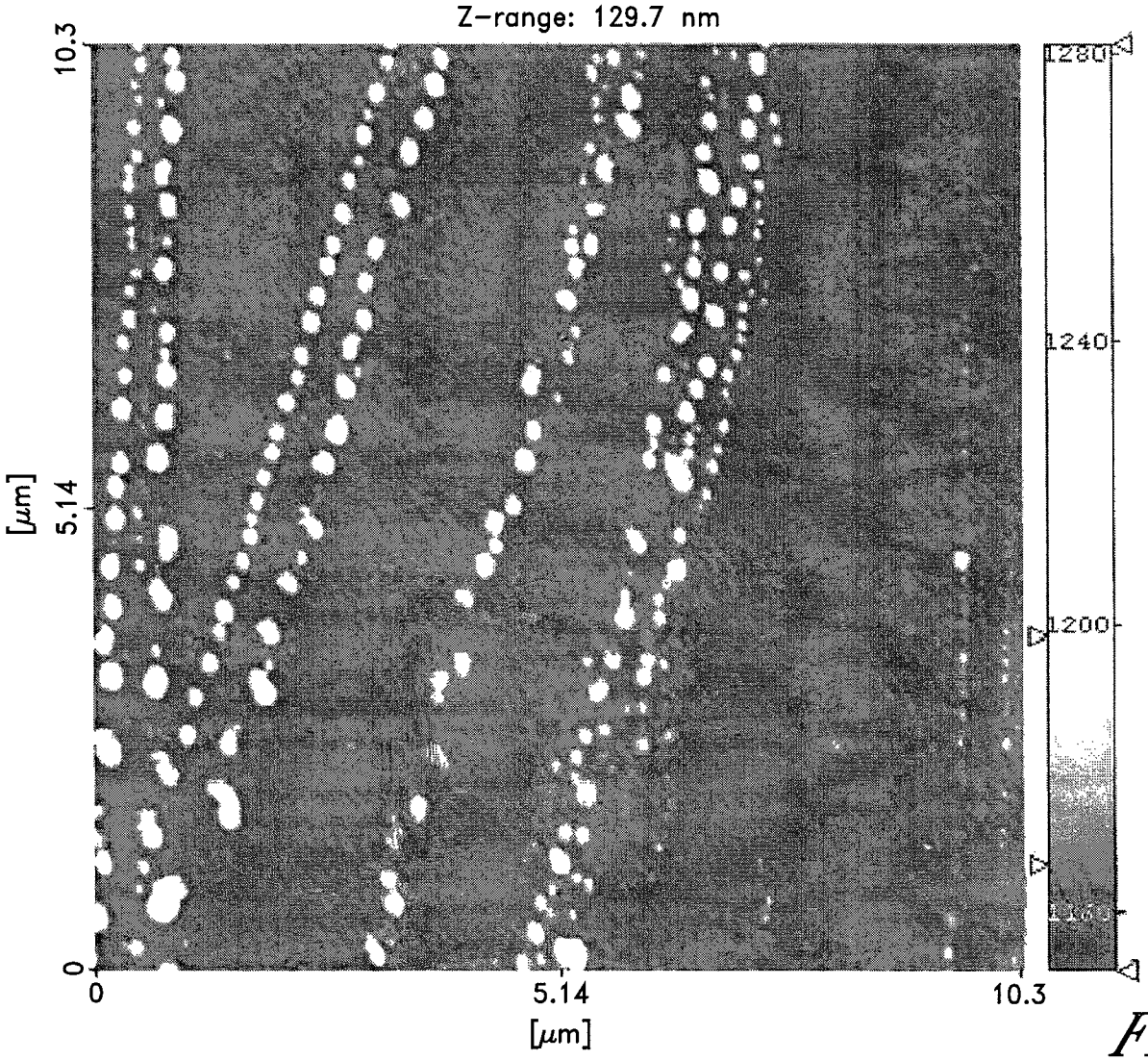

AFM images of other samples containing Alumina C show many parallel strings in the spray direction, as shown respectively in FIGS. 7 and 8. An SEM surface image of a coating sample containing Silica A is shown in FIG. 9. Some of the spherical features in AFM height images (e.g., FIGS. 5, 7, and 8) are significantly larger. These large sizes can be due to the differences in the depth of particle strings within the film. Particles (and particle lines) can be embedded in coatings at various depths. As an example, particles can be embedded near the surface of a coating, for example, within about 100 nm of the surface. This would cause the particles to appear larger in the AFM image. Other mechanisms, including the presence of nanoparticle aggregates, are also possible.

Effect of Application Parameters on Nanoparticle Distribution

The distribution of nanoparticles (e.g., linearity and length of lines) may be controlled by several factors, which include, without limitation, the shear forces and shear rates in the method used to apply the nanoparticle dispersions, coating film thickness, coating viscosities and curing temperatures. Some of these parameters are further discussed below.

i. Method of Application and Shear Rate

Figure 2:
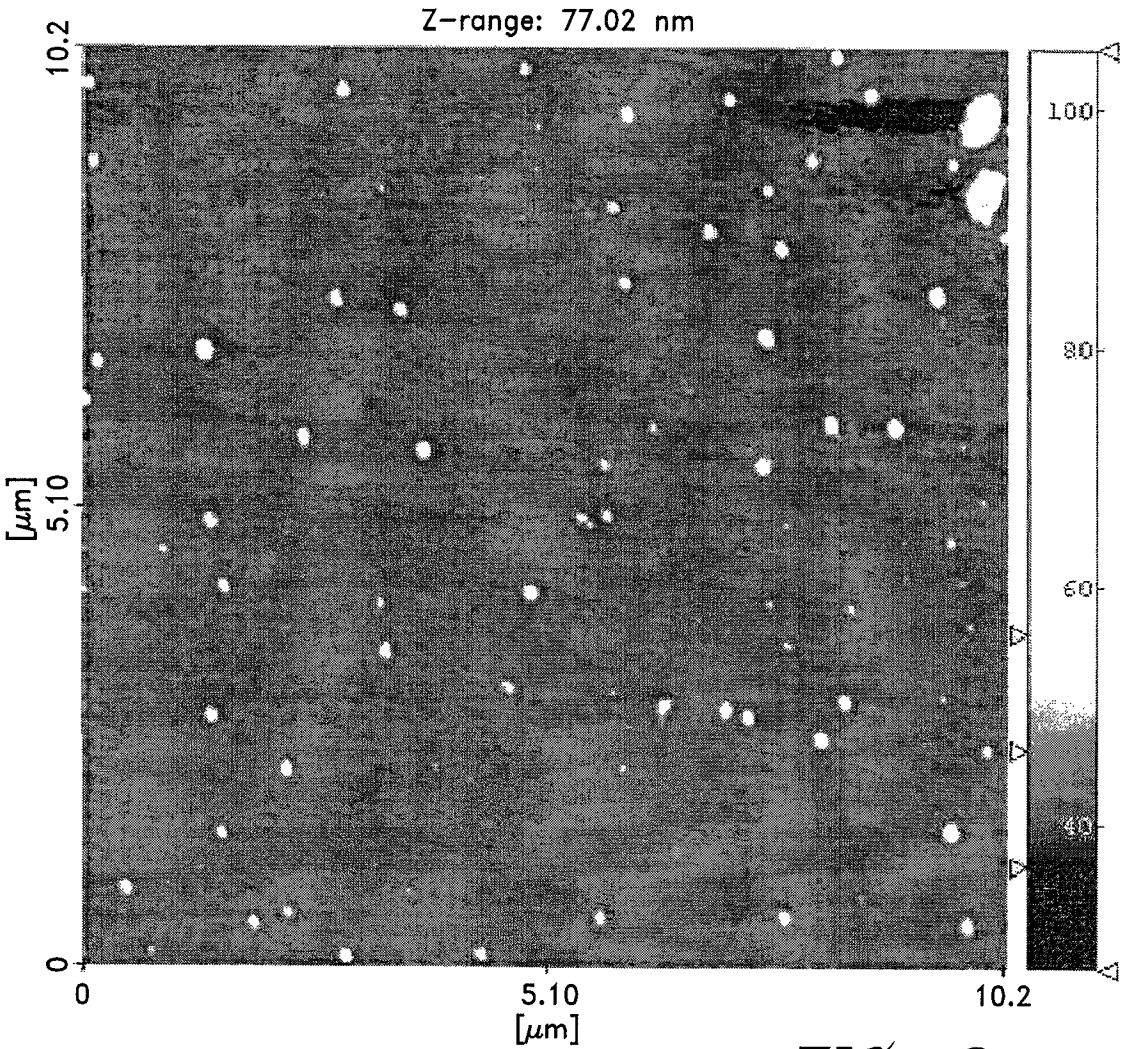
FIG. 2 shows an AFM micrograph of a coating containing Alumina C nanoparticles formed by the drop method according to an embodiment.

The distribution and alignment of the nanoparticles can be controlled by the method (e.g., drop, drawdown or spray) through which the coating (and hence the nanoparticles) are applied to a substrate surface. The distribution of nanoparticles is related to the shear rates in the application method. For example, nanoparticle lines applied through the drawdown method (low shear) have lengths up to about 300 μm and multiplicities of at least about 1-5 lines per 10 μm, whereas lines applied through the spray application method (high shear) have lengths of up to about 5 cm and multiplicities of at least approximately 10 or more lines per 10 μm (see Table 2). The drawdown method shear rate is about 650 $s^{-1}$ at a drawdown speed of about 5 cm $s^{-1}$. Shear rates in the spray method can be substantially larger than shear rates in the drawdown method. Although the modes of deformations in spray applications are complex, it is a process that involves very high shear rates. See, e.g., *J. Coat. Tech.,* 1999, 71 (890), 37 by Xing, L.-L., Glass, J. E., and Fernando, R. H., the entirety of which is incorporated herein by reference. Additionally, nanoparticles applied using the spray method form in regular, parallel lines in the direction of application, whereas nanoparticles applied using the drawdown method are less regular, as shown in FIGS. 2 and 4. When the application method involves minimal shear, such as using the drop method, no lines are observed (FIG. 2). Table 2 summarizes how the quality of linear formations is affected by the application method. Drawdowns were performed at a rate of 5 cm/s using a Sheen Instruments 25 mm Cube Film Applicator.

TABLE 2

Effect of Application Method on Length and Number of Lines

| Application Method | Shear | Length of Lines | Multiplicity of Lines |
|---|---|---|---|
| 1 Drop | Minimal | None Observed | None |
| Drawdown (3 mil) | Low | Up to 300 μm | 1-5 per 10 μm |
| Spray | High | Up to 5 cm | 10+ per 10 μm |

ii. Dispersion Medium

While this invention is not limited to theory, it appears that the distribution and alignment of the nanoparticles may also be controlled by the dispersion medium that the nanoparticles are suspended in. For example, Alumina A was dispersed in dipropylene glycol, n-butyl ether and Alumina B was dispersed in tripropylene glycol, diacrilate, as noted above in Table 2. However, neither Alumina A nor Alumina B in their respective dispersion mediums formed linear particle strings or nanowires, using any of the drop, drawdown or spray application methods.

In contrast, Alumina C, Alumina D and Silica A were all dispersed in mediums containing methoxypropyl acetate. The dispersion medium for Silica A additionally contained methoxy propanol. Since Alumina C, Alumina D and Silica A all formed linear particle strings or nanowires, and all three nanoparticles shared in common dispersion in methoxypropyl acetate, it appears that the dispersion medium may have some effect on the linear arrangement of the nanoparticles in response to a shear force.

iii. Coating Viscosity

The distribution and alignment of the nanoparticles may also be controlled by the viscosity of the coating. The viscosity of the coating can be controlled by varying the level (e.g., volume percent) of one or more solvents in the coating formulation. The viscosity, in turn, affects the mobility of the nanoparticles on the substrate surface. Nanoparticles in more viscous coatings have lower mobilities on the surface of a substrate in relation to nanoparticles in less viscous coatings. Preferably, upon application, the nanoparticles are held in place (i.e., they are substantially immobile) if substantially linear arrangements of nanoparticles are desired. Under conditions in which the nanoparticles are mobile on the substrate surface, if linear arrangements are thermodynamically unstable, they may agglomerate into more spherical arrangements in order to lower their collective surface ("free") energy. As the one or more solvents in the coating evaporate, the viscosity of the film increases, which effects a decreased mobility of the nanoparticles, thereby freezing them in place.

iv. Coating Material vs. Shear Force

To determine whether formation of the pearl-chain strings was due, at least in part, to an interaction between the nanoparticles and the coating material, or whether the nanoparticles spontaneously align when sheared, the nanoparticle dispersions were diluted in ethyl acetate and applied by the drawdown method. In one case, Nanobyk 3610 (Alumina C) was diluted in ethyl acetate at levels of about 0.000658%. Drawdowns were made at 37 microns thickness using the Cube Film Applicator (Sheen Instrument Corporation). Two application speeds were tested: 5 cm/sec and 20 cm/sec.

FIG. 10(*a*) shows an optical micrograph (1000×) of 0.000658% Alumina C in ethyl acetate, drawn at a thickness of 37 microns and a drawdown speed of 20 cm/sec. FIG. 10(*b*) shows a 25 micron AFM scan of the same 0.000658% Alumina C in ethyl acetate drawn at a thickness of 37 microns and a drawdown speed of 20 cm/sec. As shown in FIGS. 10(*a*) and 10(*b*), several nanoparticle lines can be seen in the diluted coating formed at the drawdown speed of 20 cm/sec. FIG. 10(*c*) shows a 10 micron AFM scan of 0.50% Alumina C in polyurethane coating drawn down at a thickness of 37 microns and a drawdown speed of 5 cm. As shown, only a single line of nanoparticles is visible for a coating formed at the drawdown speed of 5 cm/sec. For comparison, FIG. 10(*d*) shows a 10 micron AFM scan of 0.50% Alumina C in polyurethane coating sprayed at an approximate thickness of 10 micron. As shown, many lines of nanoparticles are visible for the coating formed by the spray method.

A comparison of the above figures show that the 5 cm/sec speed showed substantially little linear arrangement of nanoparticles (as shown in the AFM scan of FIG. 10(*c*)), while the 20 cm/sec speed showed a substantially larger amount of linear arrangement of nanoparticles (as shown in the AFM scan of FIG. 10(*b*)). Moreover, the above shows that the higher speed results in a greater number of linear particle arrangement than the lower speed, even when the coating dispersion has been diluted. For example, even the larger number of nanoparticles present in the coating mixture of FIG. 10(*c*) than in the mixture of FIG. 10(*b*) does not correspond with a larger number of nanoparticle lines, as shown. Thus, the figures appear to show that the formation of the strings are due at least in part by the shear force, and is not caused merely by the interaction of nanoparticles and the coating in the coating mixture. Estimated shear rates as low as 13 $s^{-1}$ (0.05 cm/sec at 3 mil wet coating thickness) produced strings of nanoparticles. As shown in FIG. 10(*d*), the spray method produced the largest abundance of particle strings. Although the modes of deformations in spray applications are complex, it is a process that involves very high shear rates.

Effect of Nanoparticles on Automotive Refinish Polyurethane Clear Coats

Nanoparticles applied to automotive refinish polyurethane clear coats (formulations shown in Table 3) using methods of preferred embodiments offer improved scratch resistance. Steel wool scratch tests and nano-indentation scratch tests indicate significant improvements in scratch resistance when coatings are formulated with low levels of alumina nanoparticles. Silica particles caused only slight improvements. AFM analysis of coatings indicates the presence of well dispersed nanoparticles at the surface layer.

TABLE 3

| Two-component (2K) polyurethane automotive refinish formulation | | | | | | |
|---|---|---|---|---|---|---|
| | Lbs. | Density (lb/gal) | Solids | Dry Wt. | Gal (wet) | Gal (Dry) |
| Part A (Base): | | | | | | |
| Acrylic Polyol | 329.3 | 8.70 | 0.71 | 233.8 | 37.85 | 26.87 |
| Methyl Amyl Ketone | 145.0 | 6.80 | 0.00 | 0 | 21.33 | 0.00 |
| Xylene | 45.4 | 7.26 | 0.00 | 0 | 6.25 | 0.00 |
| n-Pentyl Propionate | 33.0 | 7.26 | 0.00 | 0 | 4.55 | 0.00 |
| HALS | 3.4 | 8.26 | 0.00 | 0 | 0.41 | 0.00 |
| UV Absorber | 2.2 | 8.26 | 0.00 | 0 | 0.27 | 0.00 |
| Surface Additive | 1.7 | 8.35 | 0.25 | 0.42 | 0.20 | 0.05 |
| Total Base | 560.0 | | | 234.2 | 70.9 | 26.9 |
| Part B (Activator): | | | | | | |
| Aliphatic Polyisocyanate | 76.3 | 9.68 | 1.00 | 76.3 | 7.88 | 7.88 |
| Butyl Acetate | 63.7 | 7.34 | 0.00 | 0 | 8.67 | 0.00 |
| Component total | 700.0 | | | 377.4 | 131.5 | 34.8 |

Thus, embodiments of the invention provide shear-induced alignment of nanoparticles in coating materials such as two-component polyurethane clear coatings. 1-D strings of nanoparticles with a high degree of linearity can be formed in an extended pearl-necklace manner near the surfaces of cured films at very low particle loadings, e.g., nanoparticle weight fractions of about 1% or less. This alignment has been shown to be affected by the shear conditions of the application method according to embodiments of the invention. When applied by spraying, linear particle strings as long as 5 centimeters were observed in the direction of shear, more preferably between about 200 microns and 5 cm, more preferably greater than about 300 microns. Nanoparticle strings were also found, to a lesser extent, when coatings were applied by a drawdown method. The phenomenon was not observed in coatings applied with minimal shear. These particle string formations, in addition to affecting the performance of coatings, may have broader implications in the field of nanomaterials.

The various embodiments described above are provided by way of illustration only and should not be construed to limit the invention. Those skilled in the art will readily recognize various modifications and changes that may be made to the present invention without following the example embodiments and applications illustrated and described herein, and without departing from the true spirit and scope of the present invention.

What is claimed is:

1. A method of forming linear particle strings comprising:

providing a dispersion medium containing a plurality of nanoparticles;

incorporating the dispersion into a coating material to form a coating mixture, wherein the nanoparticles comprise about 1% weight fraction or less of the coating mixture;

applying the coating mixture to a substrate substantially in one direction with a shear force in the direction; and curing the substrate and the coating mixture by a heat treatment, wherein the nanoparticles are arranged into a plurality of substantially parallel, non-collinear linear particle strings on the substrate in the direction of application primarily by the shear force, wherein there is at least one said parallel, non-collinear linear particle string positioned per every 10 micron×10 micron area of coated substrate surface;

wherein the nanoparticles are selected from the group consisting of aluminum oxide, silicon oxide, titanium oxide, indium-tin oxide, zinc oxide and zirconium oxide, wherein the coating material comprises polyurethane, and wherein the dispersion medium comprises methoxypropyl acetate.

2. The method of claim 1, wherein curing the substrate and the coating mixture occurs at a temperature from between about 25° C. and 200° C.

3. The method of claim 1, wherein curing the substrate and the coating mixture occurs at a temperature of about 70° C. for about 30 minutes.

4. The method of claim 1, wherein applying the coating mixture comprises spraying the coating mixture onto the substrate.

5. The method of claim 1, wherein applying the coating mixture comprises drawing the coating mixture onto the substrate with a drawdown applicator.

6. The method of claim 1, wherein the nanoparticles comprise alumina or silica.

7. The method of claim 1, wherein the linear particle strings are between about 200 microns and 5 cm in length.

8. The method of claim 1, wherein there are at least 5 said parallel, non-collinear linear particle strings positioned per every 10 micron×10 micron area of coated substrate surface.

9. The method of claim 1, wherein there are at least 10 said parallel, non-collinear linear particle strings positioned per every 10 micron×10 micron area of coated substrate surface.

10. A method of forming a layer of 1-D nanowires comprising:

forming a mixture containing a plurality of nanoparticles, wherein the nanoparticles comprise about 1% weight fraction or less of the mixture; and applying a layer of the mixture to a surface substantially in one direction with a shear force in the direction, wherein the nanoparticles are arranged into a plurality of substantially parallel, linear 1-D nanowires non-collinear to each other on the surface in the direction of application primarily by the shear force, wherein there is at least one said substantially parallel, non-collinear, linear 1-D nanowire positioned per every 10 micron×10 micron area of coated substrate surface;

wherein the nanoparticles are formed of oxides of metals or of semiconductors, wherein the coating material comprises polyurethane, and wherein the dispersion medium comprises methoxypropyl acetate.

11. The method of claim 10, further comprising subjecting the surface and the mixture to a heat treatment.

12. The method of claim 10, wherein applying the layer of the mixture comprises spraying the mixture onto the surface.

13. The method of claim 12, wherein the shear force causes the mixture to shear at a rate of about 13 $s^{-1}$.

14. The method of claim 10, wherein applying the layer of the mixture comprises drawing the mixture onto the surface with a drawdown applicator.

15. The method of claim 10, wherein there are at least about 10 said substantially parallel, non-collinear, linear 1-D nanowires positioned per every 10 micron×10 micron area of coated substrate surface.

16. The method of claim 10, wherein there are at least 5 said substantially parallel, non-collinear, linear 1-D nanowires positioned per every 10 micron×10 micron area of coated substrate surface.

17. The method of claim 10, wherein the layer of nanowires comprises an automotive refinish polyurethane coat.

18. The method of claim 10, wherein the nanoparticles comprise alumina or silica.

19. The method of claim 10, wherein the plurality of substantially parallel linear 1-D nanowires are between about 200 microns and 5 cm in length.

* * * * *